US010065756B2

(12) United States Patent
Washizaki et al.

(10) Patent No.: US 10,065,756 B2
(45) Date of Patent: Sep. 4, 2018

(54) METHOD AND DEVICE FOR GAS REPLACEMENT OF CONTAINER

(75) Inventors: Toshirou Washizaki, Yokohama (JP); Tomoho Kikuchi, Yokohama (JP)

(73) Assignee: TOYO SEIKAN KAISHA, LTD., Tokyo (JP)

( * ) Notice: Subject to any disclaimer, the term of this patent is extended or adjusted under 35 U.S.C. 154(b) by 871 days.

(21) Appl. No.: 13/701,659

(22) PCT Filed: Jun. 2, 2010

(86) PCT No.: PCT/JP2010/059370
§ 371 (c)(1),
(2), (4) Date: Dec. 3, 2012

(87) PCT Pub. No.: WO2011/151902
PCT Pub. Date: Dec. 8, 2011

(65) Prior Publication Data

US 2013/0078116 A1 Mar. 28, 2013

(51) Int. Cl.
*B65B 31/04* (2006.01)
*B67C 3/22* (2006.01)
*F04F 99/00* (2009.01)

(52) U.S. Cl.
CPC ..... *B65B 31/043* (2013.01); *B67C 3/222* (2013.01); *F04F 99/00* (2013.01)

(58) Field of Classification Search
CPC ..... B65B 31/04; B65B 31/043; B65B 31/046
(Continued)

(56) References Cited

U.S. PATENT DOCUMENTS 2,184,493 A * 12/1939 Gladfelter ..... 53/279
2,693,305 A * 11/1954 Boyd et al. ..... 53/507
(Continued)

FOREIGN PATENT DOCUMENTS

JP 49-028627 7/1974
JP 57-122774 A 7/1982
(Continued)

OTHER PUBLICATIONS

English machine translation of JP 2003 312609.*
International Search Report of PCT/JP2010/059370, dated Sep. 14, 2010.

*Primary Examiner* — John K Fristoe, Jr.
*Assistant Examiner* — Andrew StClair
(74) *Attorney, Agent, or Firm* — Westerman, Hattori, Daniels & Adrian, LLP

(57) ABSTRACT

Disclosed is a device for gas replacement capable of reducing the amount of replacement gas, improving a gas replacement rate, and reducing the amount of split liquid. In a replacement nozzle (11) which blows the replacement gas toward a container opening portion symmetrically about a center line in the container radial direction, the space between nozzle port outermost walls is divided with a plurality of wind direction adjustment plates (16*a*, 16*b*) to generate a plurality of blowout ports. The replacement gas flow blowing along the outermost walls of the nozzle opening are so blown inward as to form an angle of 100° to 130°. Moreover, the replacement gas is blown from the replacement nozzle to the range between the level lower than the end of the can opening by one third or more the height of the can neck portion and the level equal to or higher than the height of the can cover.

4 Claims, 8 Drawing Sheets

(58) Field of Classification Search
USPC ..... 141/351, 352; 53/432, 510
See application file for complete search history.

(56) References Cited

U.S. PATENT DOCUMENTS

| | | | | | |
|---|---|---|---|---|---|
| 3,545,160 | A | * | 12/1970 | Earle et al. | 53/403 |
| 4,409,252 | A | * | 10/1983 | Buschkens et al. | 426/396 |
| 4,703,609 | A | * | 11/1987 | Yoshida et al. | 53/431 |
| 4,729,204 | A | * | 3/1988 | Weiss | 53/88 |
| 4,809,486 | A | * | 3/1989 | Chanel | 53/510 |
| 5,201,165 | A | * | 4/1993 | Marano et al. | 53/510 |
| 5,247,746 | A | * | 9/1993 | Johnson et al. | 53/432 |
| 5,417,255 | A | * | 5/1995 | Sanfilippo et al. | 141/1 |
| 5,617,705 | A | * | 4/1997 | Sanfilippo et al. | 53/432 |
| 6,519,919 | B1 | * | 2/2003 | Takenouchi et al. | 53/431 |
| 2007/0056251 | A1 | * | 3/2007 | Ruppman et al. | 53/432 |

FOREIGN PATENT DOCUMENTS

| | | | | | |
|---|---|---|---|---|---|
| JP | 08-324513 | A | | 12/1996 | |
| JP | 2003-312609 | A | | 11/2003 | |
| JP | 2004-59016 | | * | 2/2004 | |
| JP | 2004-059016 | A | | 2/2004 | |
| JP | 2005-059885 | A | | 3/2005 | |
| WO | WO 2005061332 | A1 | * | 7/2005 | B65B 31/04 |

* cited by examiner (a)

Flowing (spreading) of jet flow after collision at collision angle of 90°

(b)

Flowing (spreading) of jet flow after collision at collision angle of 120°

(a) (b)

Prior Art

METHOD AND DEVICE FOR GAS REPLACEMENT OF CONTAINER

TECHNICAL FIELD

The present invention relates to a method and a device for gas replacement of a container by blowing an inert gas to a head space of a container filled with contents such as a beverage can so that a gas remaining inside the head space is replaced by the inert gas, and particularly to a method and a device for undercover gassing of a can lid seaming machine.

BACKGROUND ART

In order to prevent degradation in freshness or taste due to the oxidization of contents of a container filled with contents such as a beverage can, an undercover gassing method has been widely used in a can manufacturing process. As illustrated in FIG. 10, a gas is replaced by blowing a replacement gas toward a gap between a can lid and a can body opening directly before covering an opening of a can body 30 by a can lid 33 between a gas turret 1 and a seaming turret 2. However, since the undercover gassing method has poor replacement efficiency, there has been a noticeable increasing flow amount of the replacement gas used to attain a predetermined replacement rate or more with the recent trend of an increase in speed of manufacturing lines and the variety of contents. Further, the amount of a liquid spilling from the can also tends to increase with an increase in replacement gas flow amount.

In order to improve the replacement efficiency of the undercover gassing method, there have been various attempts from the past. For example, proposed are a configuration in which a replacement gas passageway toward a replacement nozzle is formed in a large size (to form a so-called buffer) and a blowout hole group of the nozzle is provided in three stages in the longitudinal direction as a first gas jet flow hole through which a replacement gas blows to a flange of a can lid, a second gas jet flow hole through which the replacement gas blows to a space below the lid in a direction perpendicular to the can, and a third gas jet flow hole through which the replacement gas blows to a wall portion below a can opening edge (Patent Document 1), a configuration in which a branch body is provided at a center portion of a replacement gas jet passageway so as to branch a gas flow left and right and left and right nozzles are formed so that replacement gases jetted from the pair of nozzles collide with each other at a center portion of an upper space inside the can so as to direct the replacement gas to a liquid surface of a head space of the can (Patent Document 2), a configuration in which replacement gases blowing from a pair of left and right blowout ports collide with each other on the substantially straight collision region (Patent Documents 3 and 4), and the like. FIGS. 11 and 12 illustrate an example of a nozzle body 50 of the prior art provided in a pocket of a gas turret as illustrated in the Patent Document 3. Left and right branched replacement gas passageways 51*a* and 51*b* are divided by a wind direction adjustment plate 52 so as to form opposing blowout ports 53*a* and 53*b*, and the replacement gases symmetrically blow from the blowout ports to a gap between the can body and the can lid. However, in the conventional nozzle body, since can lid transfer fingers 55 are provided on the gas turret body at the same level position as that of the nozzle body so as to be positioned at the outside of both end portions as illustrated in the front view of the pocket of the gas turret of FIG. 12, an angle θ between outermost walls 54*a* and 54*b* of the nozzle blowout ports may be set to only 90° or less (normally, 80°).

PRIOR ART DOCUMENTS

Patent Documents

Patent Document 1: JP 49-28627 B
Patent Document 2: JP 8-324513 A
Patent Document 3: JP 2004-59016 A
Patent Document 4: JP 2005-59885 A

SUMMARY OF INVENTION

Problem to be Solved by the Invention

In the method of replacing the gas of the container, it is the most ideal gas replacement method capable of simultaneously decreasing three amounts, that is, the residual oxygen amount inside the container, the consumption amount of the replacement gas, and the liquid amount spilled from the container at the replacement time. Then, any proposed method of the prior art aims to attain the ideal technical object, but these problems are technically contradicted each other. That is, if one demand is satisfied, the other demand needs to be ignored. Accordingly, it is difficult to simultaneously decrease three amounts, and hence there is still no satisfactory method. For example, according to the method of the Patent Document 1, the residual oxygen amount may be decreased (that is, the replacement rate may be improved) when increasing the replacement gas flow amount, but there is a problem in that a large amount of the replacement gas is consumed. On the other hand, in the methods illustrated in the Patent Documents 2 to 4, the replacement gas flows collide with the liquid surface by causing the collision of the jet flows along the center portion or the center line inside the container, and hence the replacement gases are effectively supplied to the vicinity of the liquid surface, thereby improving the replacement efficiency. However, since there is a need to increase the speed of the replacement gas jet flow so as to improve the replacement efficiency, there is a problem in that liquid easily spills due to the impact of the replacement gas flow colliding on the liquid surface. Since the undercover gassing is performed at an unstable position where the can is transferred from a straight track to a circular track, there is another problem in that liquid easily spills even by a small impact with the recent high-speed manufacture. Accordingly, in the above-proposed methods, the liquid spilled amount may not be satisfactorily decreased yet. Further, since a large amount of the replacement gas is conventionally needed in order to improve the replacement rate, the manufacture cost increases. Accordingly, for a manufacturer or a bottler that manufactures a large number of cans, there has been a demand for a drastic decrease in the replacement gas consumption amount.

Therefore, the invention solves the above-described problems. That is, it is an object of the invention to provide a method and a device for gas replacement capable of simultaneously decreasing three amounts, that is, a residual oxygen amount, a replacement gas consumption amount, and a liquid amount spilled from a can at a replacement time, drastically decreasing particularly the replacement gas amount compared to the prior art, and improving a gas replacement rate.

Means for Solving the Problem

In order to solve the above-described problems, the inventor has conducted a careful examination and contrived the titled invention. That is, in an undercover gassing device, an opening angle between outermost walls of nozzle ports is formed in a specific range larger than that of the conventional nozzle, and hence it is possible to improve a gas replacement rate compared to the prior art. Further, an opening height of the blowout port is set to be high, and hence the replacement gas blows to a container opening upper portion and a container upper portion including a can neck portion. By such improvement, it is possible to improve the gas replacement rate by drastically decreasing the replacement gas consumption amount compared to the prior art to the extent which is not able to be expected in the prior art, and hence to drastically decrease the spilling of the liquid.

That is, as a gas replacement method of the invention for solving the above-described problem, provided is a gas replacement method (1) of laterally blowing a replacement gas from a replacement nozzle toward a gap between a can lid and a can body opening directly before covering an opening of a can body filled with contents by the can lid so that a gas remaining inside a head space of the can body is replaced by the replacement gas, in which the space between nozzle port outermost walls of the replacement nozzle are divided by a wind direction adjustment plate so as to form a plurality of blowout ports, and in which in replacement gas jet flows symmetrically blowing about a center line in the container radial direction from the blowout ports, the replacement gas jet flows blowing along the nozzle port outermost walls form an angle of 100° to 130° therebetween.

Further, as another gas replacing method of the invention for solving the above-described problem, provided is a gas replacement method (2), in which the space between nozzle port outermost walls of the replacement nozzle are divided by a plurality of wind direction adjustment plates so as to form a plurality of blowout ports, and in which the replacement gas flow blows from the replacement nozzle to a range having a depth of ⅓ or more of a height of a can neck portion at the lower side from a can opening end or a depth of a 3 mm or more in the can body direction from the can opening end and a height of a can lid height or more at the upper side or a height of 3 mm or more at the upper side from the can opening end. The range of the replacement gas flow blowing from the replacement nozzle may cover a depth of ⅓ or more of the height of the can neck portion at the lower side from the can opening end in the case of the can body (a height of a neck-in processed portion: 5 to 20 mm) in which the can body for the replacement of the gas is subjected to a neck-in process of a normal height. However, the range may cover a depth of 3 mm or more in the can body direction from the can opening end in the case of the can body which is not subjected to the neck-in process or the can body of which the neck-in processed portion is long. Similarly, in the case of the can lid in which the height of a chuck wall portion is normal (the height of the chuck wall portion: 4 to 8 mm), the upper side from the can opening end may be the can lid height or more. However, in the case of the can lid in which the height of the chuck wall portion is lower or higher than that of the normal can body, the upper side is set to the range of 3 mm or more from the can opening end.

Further, another gas replacement method of the invention for solving the above-described problem has the configurations (1) and (2). Accordingly, it is possible to further improve the replacement rate at the smaller replacement gas amount and to decrease the liquid spilled amount.

Then, as a gas replacement device of the invention for solving the above-described problems, provided is a gas replacement device (1) which laterally blows a replacement gas from a replacement nozzle toward a gap between a can lid and a can body opening directly before covering an opening of a can body filled with contents by the can lid so that a gas remaining inside a head space of the can body is replaced by the replacement gas, in which the space between in the container nozzle port outermost walls of the replacement nozzle are divided by a wind direction adjustment plate so as to form a plurality of blowout ports which are arranged on a circular-arc and jet the replacement gases toward a container opening so as to be symmetrical about a center line in the container radial direction, and an opening angle between the nozzle port outermost walls is 100° to 130°.

Further, another gas replacement device of the invention for solving the above-described problems is provided in the gas replacement method (2) of blowing a replacement gas from a replacement nozzle to a head space of a container filled with contents so that a gas remaining inside the head space is replaced by the replacement gas, in which the space between nozzle port outermost walls of the replacement nozzle are divided by a plurality of wind direction adjustment plates so as to form a plurality of blowout ports, and in which the replacement gas flow blows from the replacement nozzle to a range having a depth of ⅓ or more of a height of a can neck portion at the lower side from a can opening end or 3 mm or more in the can body direction from the can opening end and a height of a can lid height or more at the upper side or 3 mm or more at the upper side from the can opening end, so that the replacement gas laterally is blown toward a gap between a can lid and a can body opening directly before covering the opening of the can body filled with the contents by the can lid.

Further, another gas replacement device of the invention for solving the above-described problems has the configurations (1) and (2). Accordingly, it is possible to improve the replacement rate at the smaller replacement gas amount and to reduce the spilling of the liquid. It is desirable that the wind direction adjustment plates be arranged in parallel to each other.

Effect of Invention

According to the invention, there is a particular effect compared to the prior art in that the replacement rate equaling or surpassing that of the prior art may be ensured at the smaller replacement gas flow amount by the improvement of the prior art and the liquid spilled amount may be decreased without any limit.

REFERENCE SIGNS LIST

Figure 1:
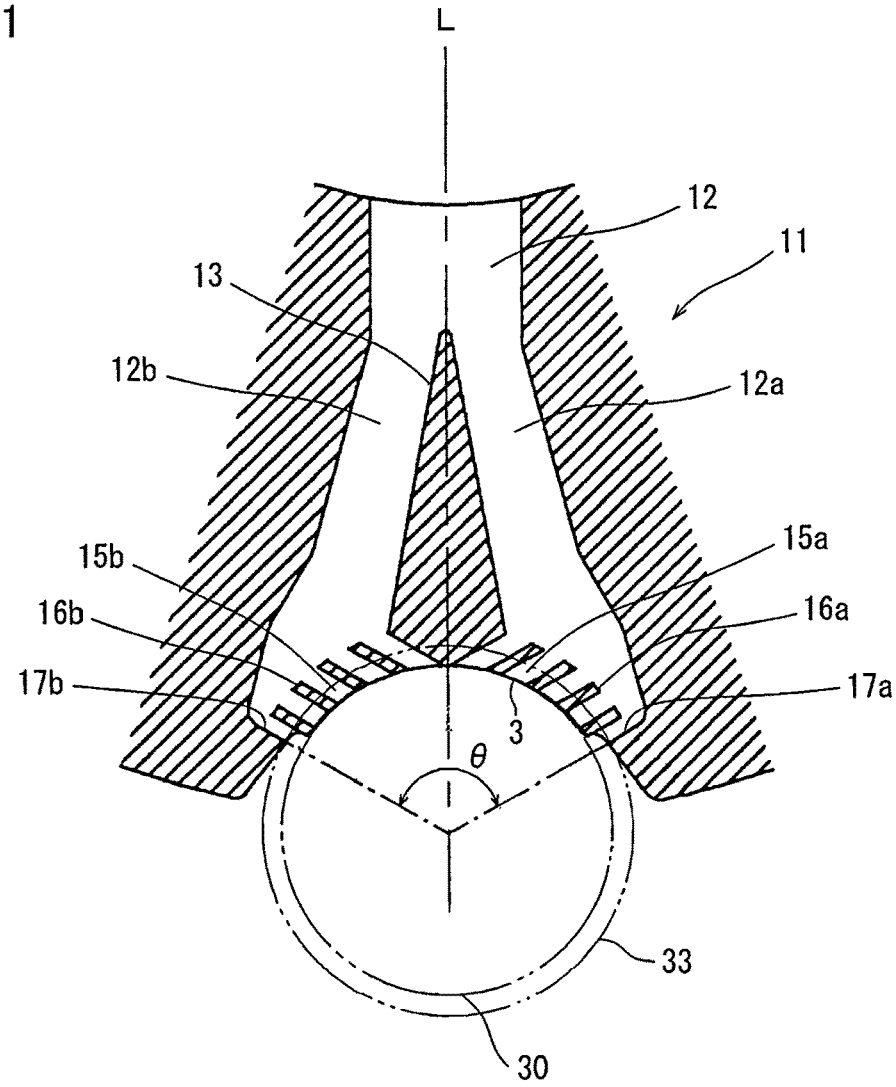
FIG. 1 is a schematic plane view of a gas replacement device according to an embodiment of the invention, and is a plane cross-sectional view of a replacement gas passageway excluding a finger portion.

1: Gas turret
2: Seaming turret
3: Circular-arc concave portion (pocket)
4: Finger
10: Gas turret body
11, 40: Nozzle body
12, 12-1, 12-2, 41: Replacement gas passageway
13: Branch plate
14: Replacement gas supply opening
15, 15-1, 15-2, 42: Replacement gas blowout port (Blowout port)
16, 43: Wind direction adjustment plate
17*a*, 17*b*, 46*a*, 46*b*: Outermost wall
30: Can body
31: Neck portion
33: Can lid
34: Chuck wall Description Of Embodiments Hereinafter, an embodiment of the invention will be described in detail based on the drawings.

Figure 10:
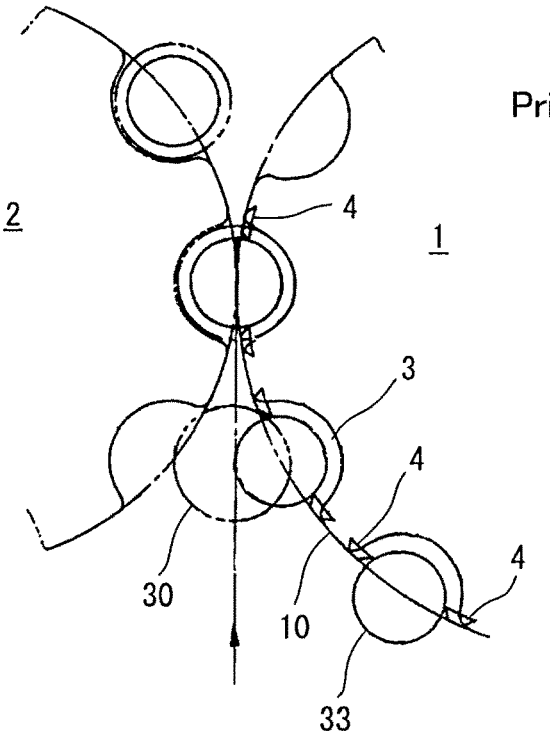
FIG. 10 is a schematic diagram illustrating a planar arrangement of an undercover gassing device of a can seaming device.

FIG. 1 is a plane cross-sectional view of a nozzle body of an undercover gassing device according to an embodiment of a gas replacement device of the invention, and the nozzle body is provided so as to face circular-arc concave portions (pockets) 3 of a gas turret 1 illustrated in FIG. 10. A nozzle body 11 is fixed to a top surface of a gas turret body 10 of the gas turret 1, and a replacement gas passageway 12 which goes through each circular-arc concave portion 3 is formed inside the nozzle body.

Figure 3:
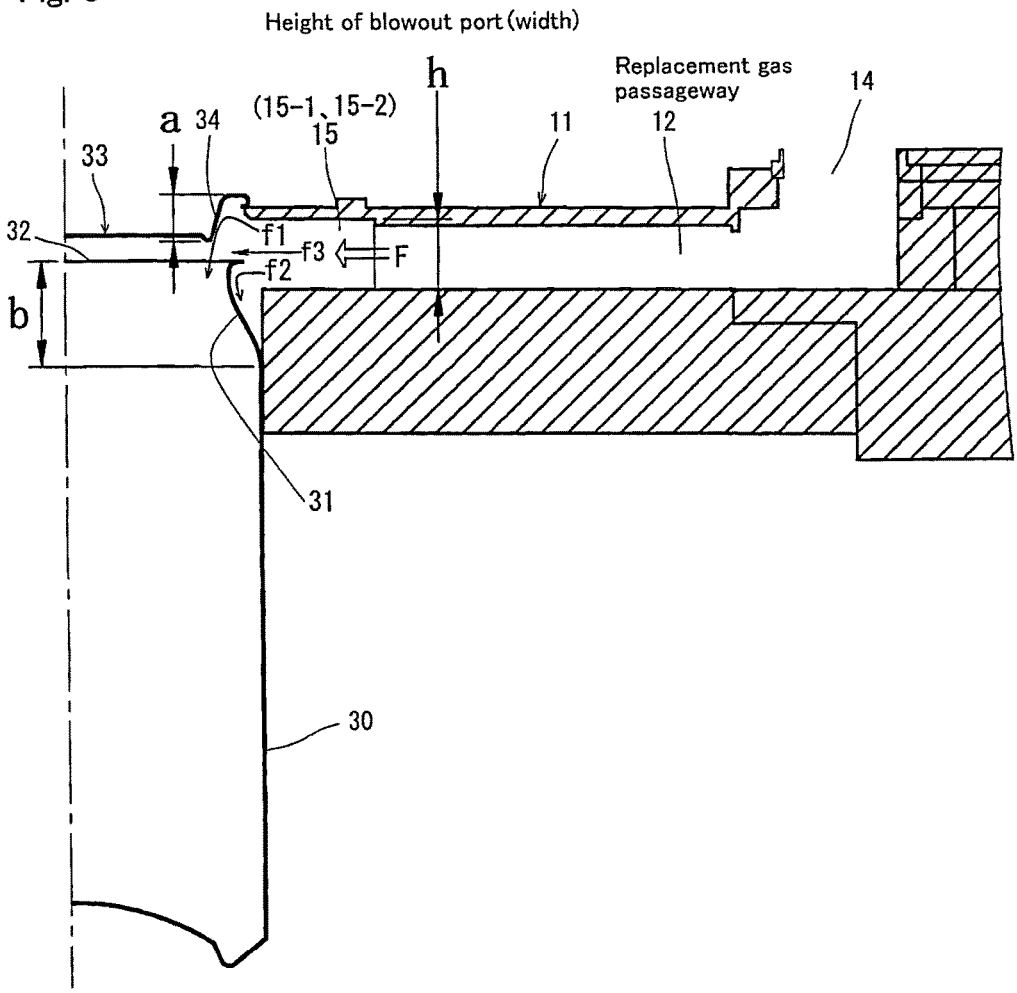
FIG. 3 is a schematic diagram of a cross-section of a nozzle body illustrating a relation between a can body and a can lid of the gas replacement device according to the embodiment of the invention.

In the embodiment, in order to decrease a replacement gas amount, the replacement gas passageway 12 which reaches a replacement gas supply opening 14 is formed so that the height thereof is straight and no buffer is provided in the course thereof as illustrated in FIG. 3. Although the replacement gas passageway 12 is widened in a taper shape from the replacement gas supply opening 14 toward the circular-arc concave portion 3, the replacement gas passageway is halfway branched into gas passageways 12*a* and 12*b* by a branch plate 13, replacement gas blowout ports (hereinafter, referred to as blowout ports) of the front end portions thereof are divided by a plurality of parallel wind direction adjustment plates 16*a* and 16*b*, and groups of a plurality of parallel blowout ports 15*a* and 15*b* are formed toward the circular-arc concave portion, thereby forming an jet nozzle. The respective groups of the blowout ports 15*a* and 15*b* are symmetrically formed about the center line L, an angle θ between outermost walls 17*a* and 17*b* of the blowout ports forms an angle of 100° to 130°, and the wind direction adjustment plates 16*a* and 16*b* are provided so as to be respectively parallel to the outermost walls 17*a* and 17*b*. Accordingly, in the embodiment, even in the respective blowout ports, an angle θ between the facing blowout ports forms an angle of 100° to 130°, and the replacement gases which blow from the facing blowout ports collide with each other on the center line L.

Figure 11:
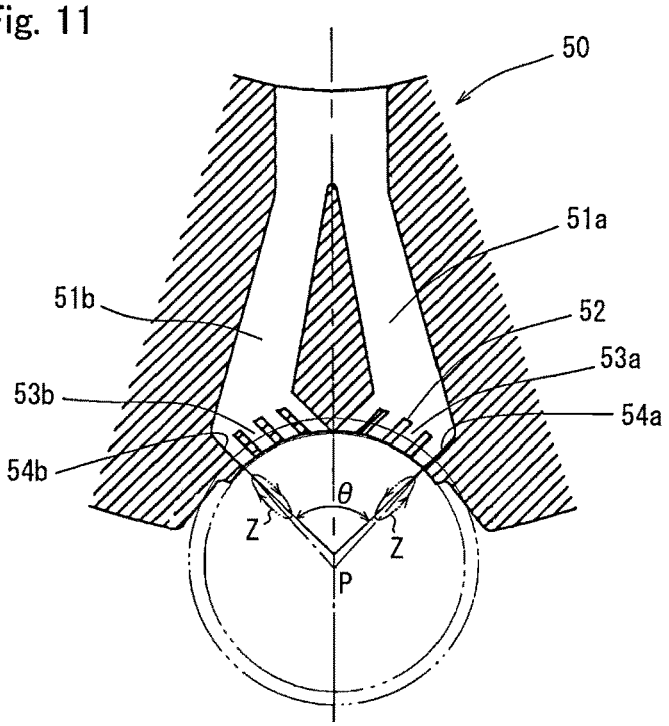
FIG. 11 is a schematic plane view of a gas replacement device of a parallel comb-shaped nozzle of the prior art, and is a plane cross-sectional view of a replacement gas passageway excluding a finger portion.
Figure 12:
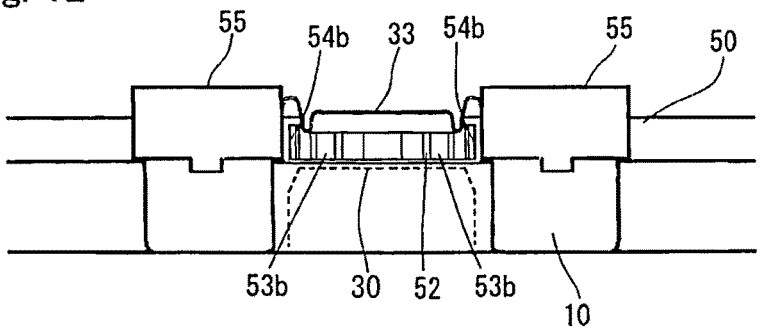
FIG. 12 is a main front view when seen from a circular-arc concave portion of the gas replacement device illustrated in FIG. 11.

The angle of 100° to 130° between the blowout ports is set to a large angle due to the technical reasons below compared to the angle of about 80° between the blowout ports of the gas turret of the prior art as illustrated in FIGS. 11 and 12. That is, the inventor has examined a reason why a gas replacement rate is not improved by an undercover gassing method of the prior art. During the examination, the inventor found a method of increasing the opening area width (the blowing angle) of the blowout port as means for solving problems in which a vortex is generated at an outside position Z of a nozzle blowout port base indicated by an imaginary line in FIG. 11 in a container opening of a nozzle body of the prior art and a gas stays at the portion so that the gas is not satisfactorily replaced and a liquid spills when replacing the gas, and thereby solving the problems. However, as illustrated in FIGS. 11 and 12, in the gas turret 1 of the prior art, fingers 55 which convey a can lid 33 placed on the outer edge of the pocket so as to be positioned at the pocket are provided in both end portions of the circular-arc concave portion 3 of the gas turret body 10, and a nozzle body 50 is provided therebetween. For this reason, the installation range of the blowout ports arranged in the peripheral surface of the pocket is limited, and hence the installation angle is only within 100° at maximum. In general, the installation angle is only about 80°.

Figure 2:
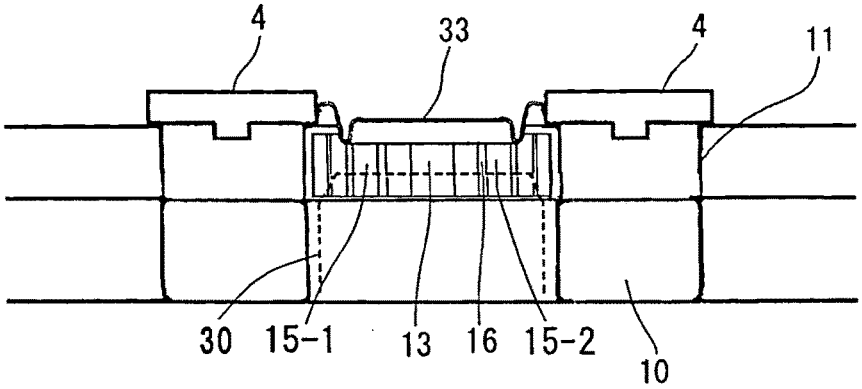
FIG. 2 is a main front view when seen from a circular-arc concave portion.

Thus, in the invention, in order to widen the installation range of the replacement nozzle, the finger 55 of the prior art is removed from the gas turret body 10, a nozzle body having a range of a replacement nozzle widened to a position where the finger of the prior art is positioned is formed, and as illustrated in FIGS. 1 and 2, fingers 4 and 4 are provided on the nozzle body 11. Accordingly, regarding the range of the replacement nozzle, the angle between the outermost walls 17*a* and 17*b* may be widened to 130° as illustrated in FIG. 1, and the opposing angle of the blowout ports may be 130°. As a result, the jet passageway area width may be widened. Accordingly, it is possible to decrease the flow rate when injecting the replacement gas at the same flow amount and to suppress the generation of a vortex of a head space.

Furthermore, in the invention, in order to decrease the amount of entrained air positioned at an outer peripheral portion of a neck portion 31 of a can body 30 as illustrated in FIG. 3 when blowing the replacement gas from the replacement nozzle, a height h of a blowout port 15 of the replacement gas nozzle is made to be higher than the sum of a can lid height a and ⅓ of a length of a can neck portion so as to form a replacement gas atmosphere around the outer surface of the neck portion 31, whereby the height of the jet passageway area is made to be larger than that of the parallel nozzle of the prior art. FIG. 3 illustrates a state where the can body conveyed by a conveyer is transferred while being placed on a lifter of a seamer, the upper side of the opening is positioned between the fingers positioned at both end sides of the pocket of the gas turret, and the can lid conveyed along the circular-arc track is positioned above the can opening. Then, in this state, the vertical center of the gas flow blowing from the blowout port of the nozzle is substantially set to be positioned in the vicinity below the lowermost end portion of the can lid, and the height of the nozzle port is set so that the replacement gas flow blowing from the blowout port blows to the range having a depth of ⅓ or more of the height of the can neck portion 31 at the lower side from a can opening end 32 or a height of 3 mm or more in the can body direction from the can opening end and corresponding to an outer peripheral surface of a chuck wall 34 of the can lid positioned at the upper side with a gap therebetween.

More specifically, it is desirable that the height of the blowout port, that is, the length h of the gas passageway in the height direction satisfy a relation of $a+b/3 \leq h \leq a+b/1.5$ when the can upper portion is provided with the neck portion as illustrated in FIG. 3, where the length of the can neck portion is denoted by b. When the height h of the gas passageway in the height direction is lower than the above-described range, the jet flow rate becomes faster. Accordingly, the liquid may easily spill and the amount of the entrained external air increases, thereby causing a problem in which it is difficult to improve the replacement rate. On the contrary, when the height is higher (larger) than the above-described range, the flow rate of the replacement gas becomes slower, and hence the air remaining inside the can body may not be sufficiently removed. As a result, the above-described range is desirable.

In the can shape, the neck portion is optional or various neck shapes are present. Even in the lid shape, the lid may have various heights. Accordingly, in order to handle these options, the specific numerical values are set as below. In the direction of the body based on the can opening portion, the height is desirably in the range of 3 mm or more from the can opening end and is more desirably in the range of 5 mm or more therefrom. Then, in the direction of the can upper portion, the height is desirably in the range of 3 mm or more from the can opening end and is more desirably in the range of 8 mm or more therefrom. Accordingly, the height of the passageway of the nozzle body of the undercover gassing of the prior art is about 8 mm, but in the embodiment, the height h of the gas passageway is set to be about 13 mm.

As described above, in the invention, the height of the opening area of the blowout port 15 of the replacement gas nozzle is made to be higher than the sum of the height of the can lid and ⅓ of the length of the can neck portion, so that the height of the jet passageway area is made to be higher than that of the parallel nozzle of the prior art. As illustrated in FIG. 3, the gas which blows from the blowout port collides with the chuck wall of the lid and generates a down flow f1 flowing into the can, a parallel flow f3 flowing into a gap between the lid and the can in parallel, and a flow f2 colliding with the can neck portion. However, at this time, the flow f3 which is parallel to the gap weakens the down flow f1 and alleviates the collision of the flow f1 with respect to the liquid surface. When the down flow f1 collides with the liquid surface S, the liquid surface around the collision position is raised. When the down flow f1 is alleviated, the fluctuation amount of the liquid surface becomes smaller, so that the liquid hardly spills.

Figure 7:
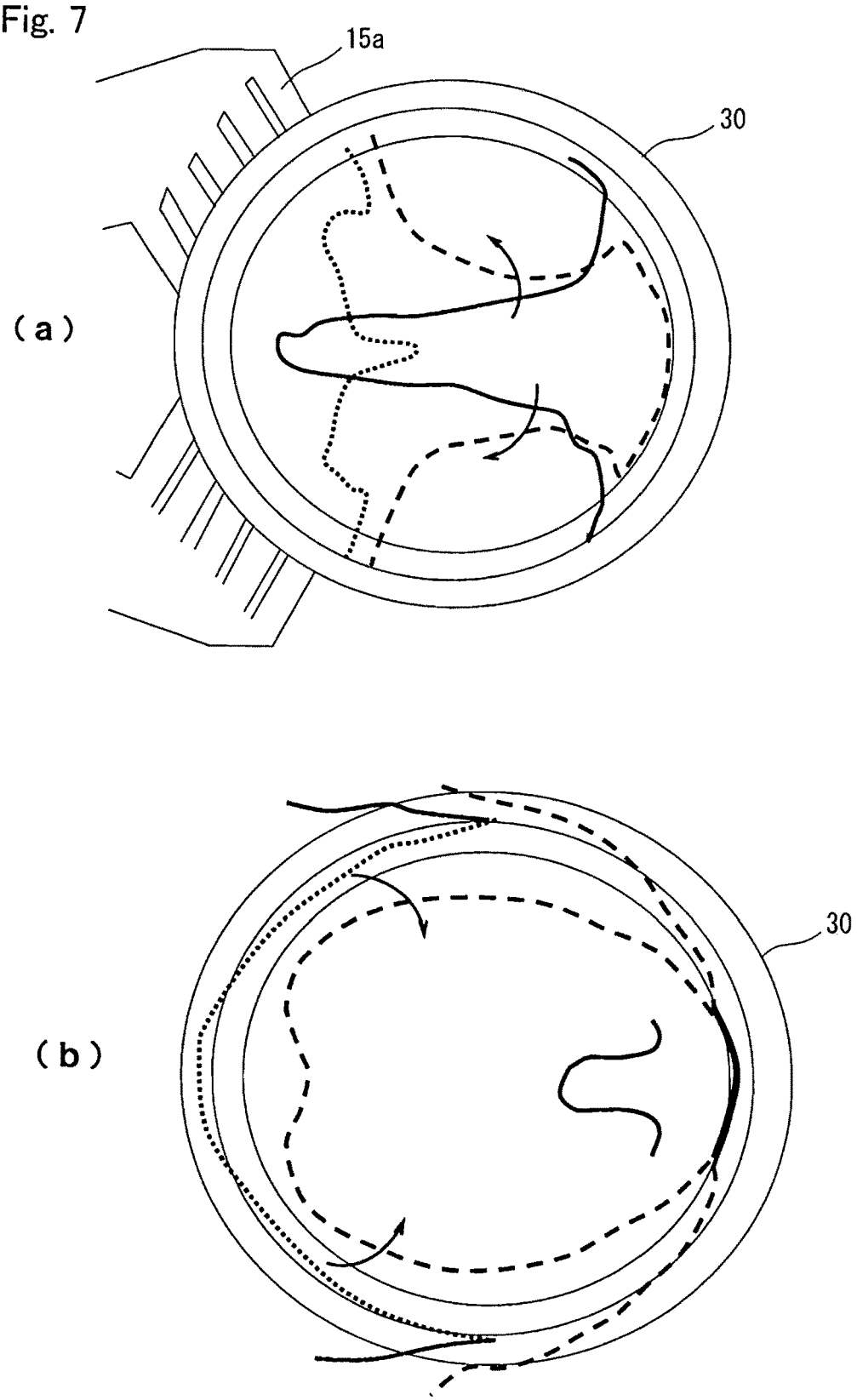
FIG. 7 is a numerical analysis diagram illustrating a state where a replacement gas flows in the planar direction in an undercover gassing time, where FIG. 7(*a*) illustrates a case of a nozzle body in which an angle between outermost walls according to the invention is 120°, and FIG. 7(*b*) illustrates a case of a nozzle body in which an angle between outermost walls according to the prior art is 80°.

The gas replacement device of the embodiment has the above-described configuration. The replacement gas flows F which are jetted from the blowout ports 15*a* and 15*b* collide with each other along the center line L while forming an angle of 100° or greater and 130° or less, and blown into the head space inside the can while being bent in the axial direction of the can body, so that the replacement gas flow collides with the collision region including the gas passageway side edge of the can 30. Accordingly, the replacement gas may be also blown to the head space around the gas passageway side edge which is difficult in the undercover gassing of the prior art, and hence it is possible to effectively replace the gas at the portion. In order to examine a reason why the replacement rate is improved at a small gas flow amount by setting the angle of the outermost blowout port to 100° or more so as to widen the jet port width, the flow of the jet gas is numerically analyzed by a computer. The result is illustrated in FIG. 7. The drawing illustrates an inflowing front surface of a concentration of 90% of the replacement gas blowing from the nozzle at the same timing. In FIG. 7, FIG. 7(*a*) illustrates a case where the opening angle is 120° and FIG. 7(*b*) illustrates a case where the nozzle port angle of the prior art is 80°, where the temporal elapse of the flow of the gas is sequentially indicated by a short chain line, along chain line, and a solid line. As a result, in the nozzle of the invention in which the opening angle is large, the gas flow which blows from the blowout port firstly flows to the center portion and collides with the opposite can wall so as to become left and right flows pushing the air as in the shapes of the hands of the breaststroke. Since the pushing-out space is wide, the gas may be efficiently replaced at a small flow amount. On the other hand, in the case of the nozzle structure of the prior art in which the opening angle is 80°, the replacement gas is filled from the outside of the head space, and the flow pushing the inner air forward later is generated. Accordingly, since the pushing-out space is narrowed, a large amount of the replacement gas is needed by the amount.

Figure 8:
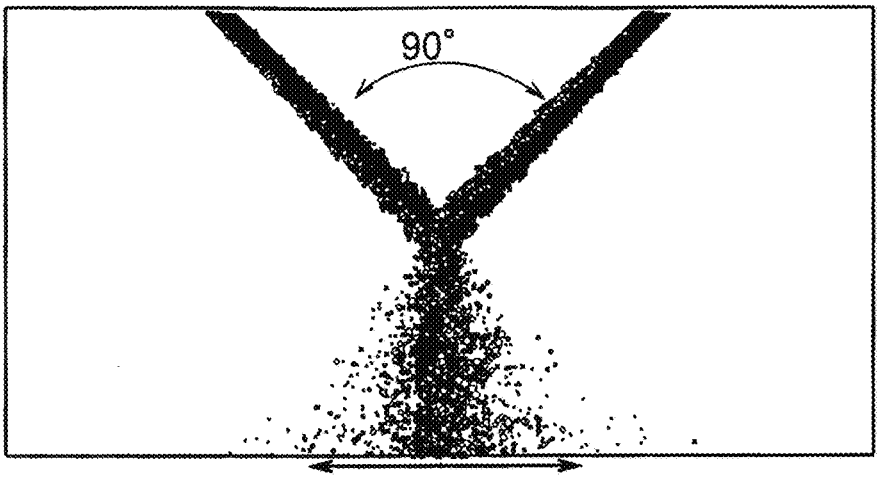
FIG. 8 illustrates a numerical analysis result of a jet flow which blows from a bidirectional blowout port of the nozzle body and spreads in the axial direction of the can body after collision, where FIG. 8(*a*) illustrates a case where a collision angle according to the nozzle body of the prior art is 90° and FIG. 8(*b*) illustrates a case where a collision angle according to the nozzle body of the invention is 120°.
Figure 8:
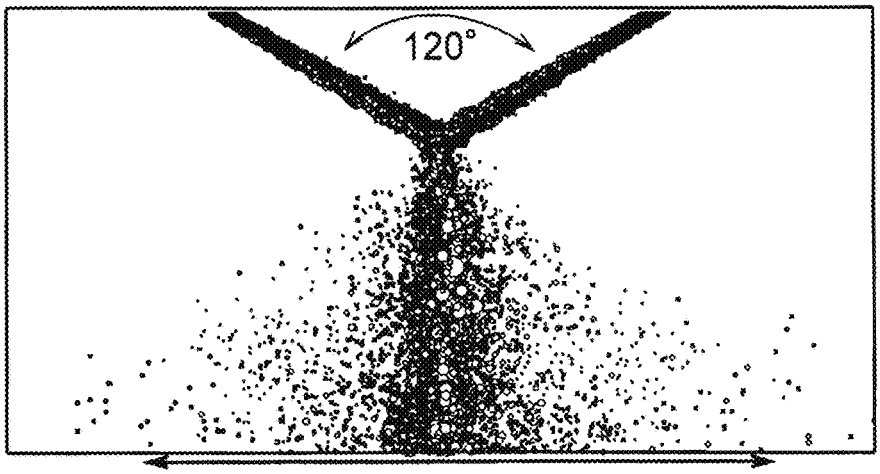

The influence in which the opening angle is widened to 120° leads to an increase in the angle of the colliding jet flows. FIG. 8 illustrates a bidirectional colliding jet flow, where FIG. 8(*a*) illustrates a case where the collision angle is 90° and FIG. 8(*b*) illustrates a case where the collision angle is 120°. By these drawings, the numerically analyzed result of the spreading after the collision is illustrated. From FIG. 8(*b*), it is proved that the spreading area after the collision is wide when the collision angle is 120°. It is considered that when the angle of the colliding jet flow is set to be large, the area where the replacement gas spreads after the collision becomes wider, and hence the replacement efficiency is improved.

Figure 9:
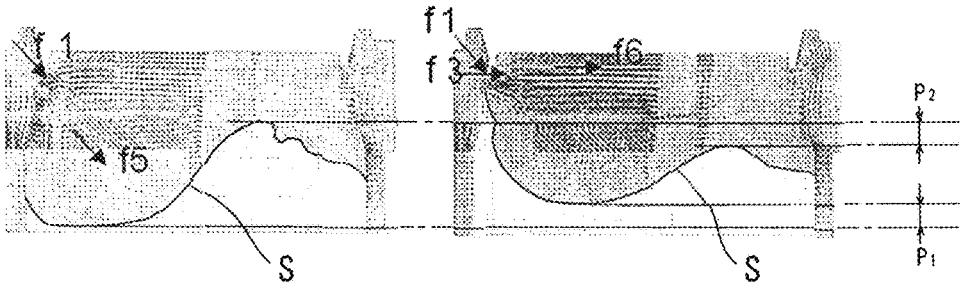
FIG. 9 is a numerical analysis diagram illustrating a state where a liquid surface fluctuates due to the collision of the replacement gas blowing from the nozzle body with respect to the liquid surface, where FIG. 9(*a*) illustrates a case where a height of a nozzle port according to the nozzle body of the prior art is 8 mm and FIG. 9(*b*) illustrates a case where a height of a nozzle port according to the nozzle body of the invention is 13 mm.

Further, in this invention, the opening height of the replacement gas passageway is made to be higher than that of the prior art as described above, the operation and the effect thereof were examined by the numerical analysis as in the influence by the opening angle. The result is illustrated in FIG. 9. In FIG. 9, FIG. 9*a*) illustrates a case where the opening height of the blowout nozzle of the prior art is set to 8 mm and FIG. 9(*b*) illustrates a case where the opening height of this invention is set to 13 mm. As illustrated in the drawing, in the case of the opening height of 8 mm, the liquid surface S colliding with the replacement gas is pushed inward by P1 compared to the case of 13 mm, and the liquid surface S is highly raised at the downstream side by P2 by the amount. That is, in the case of the opening of 8 mm of the prior art, the opening area is narrow and the flow rate is fast by the amount. Further, most of the replacement gas flow f1 blown from the nozzle port collides with the chuck wall portion of the can lid and flows into the gap between the can and the lid. Accordingly, a strong down flow f5 as illustrated in FIG. 9(*a*) is generated, and collides with the liquid surface before the blowout port, so that the liquid surface S is highly raised in the advancing direction. On the other hand, in this invention, the flow rate decreases with an increase in the opening height of the blowout port, and hence the amount of the replacement gas colliding with the liquid surface decreases. Accordingly, since a parallel flow f6 as illustrated in FIG. 9(*b*) weakens the replacement gas flow f1 of the prior art, the wavy movement of the liquid surface S in the advancing direction is alleviated. As a result, it is possible to reduce an influence of the replacement gas flow on the spilling of the liquid as much as possible and to further decrease the residual oxygen amount inside the can body at a small replacement gas flow amount.

Specifically, in this invention, the height h of the gas passageway is formed to be higher than the sum of the can lid height a and ⅓ of the length b of the can neck portion. As a result, as illustrated in FIG. 3, in the replacement gas flow F, the gas flow f1 which is jetted from the upper portion of the nozzle port collides with the outer surface of the chuck wall 34 of the can lid, advances to the head space, and beats the liquid surface. However, in the case of this invention, since the opening area of the nozzle is large as described above, the flow rate decreases. Accordingly, the impact on the liquid surface is small and the liquid surface collision flow is weak. Then, it is possible to suppress the spilling of the liquid in the advancing direction by pushing the liquid surface around the gas passageway edge upward and to efficiently replace the gas around the liquid surface and the can inner peripheral surface. On the other hand, the gas flow f2 of the lower portion of the nozzle port collides with the outer peripheral surface of the neck portion 31 of the can, and surrounds the vicinity thereof by the replacement gas atmosphere, thereby preventing the external air from being suctioned into the can.

Figure 4:
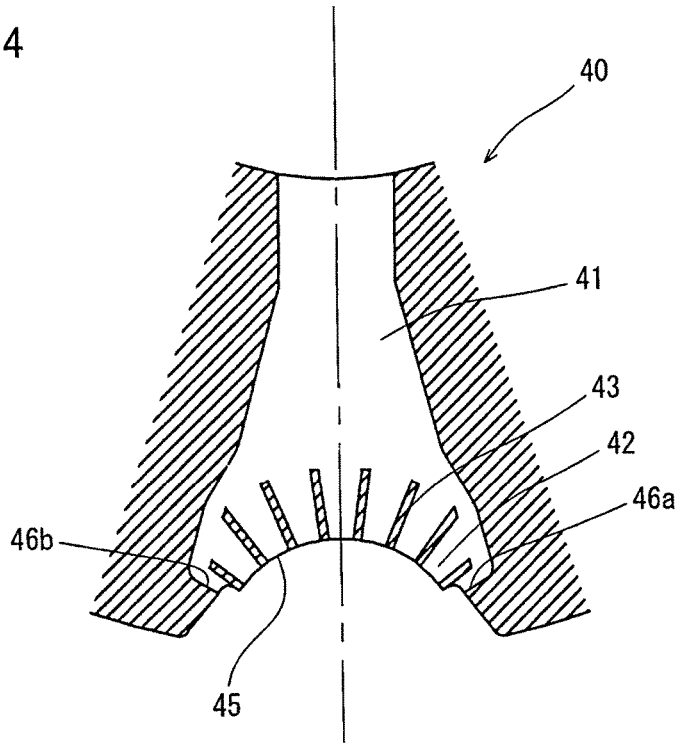
FIG. 4 is a schematic plane view of a gas replacement device according to another embodiment of the invention, and is a plane cross-sectional view of a replacement gas passageway excluding a finger portion.

FIG. 4 illustrates another embodiment of a nozzle body of a gas replacement device of the invention. A nozzle body 40 of the embodiment is different from the nozzle body illustrated in FIG. 1 in that the replacement gas passageway is not branched, a replacement gas blowout port 42 is evenly formed along the outer peripheral surface of a circular-arc concave portion 45, and the gas replacement gas blowout ports are radially arranged so that the replacement gas is substantially blown to the center portion of the circular-arc. For this reason, in the embodiment, wind direction adjustment plates 43 are radially arranged. Then, the opening angle between the outermost walls 46*a* and 46*b* of the gas replacement gas blowout ports is widened to 100 to 130° as in the above-described embodiment and the opening height is set such that the blowout port has an opening in the height direction which is higher than the sum of the can lid height and ⅓ of the height of the can neck portion for the replacement of the gas as in the above-described embodiment.

EXAMPLES

In order to check the operation and the effect of the invention, the following conditions were set. Then, in the cases where the undercover gassing was performed by the gas replacement device of the can seaming device illustrated in the embodiment of FIGS. 1 to 3 and the gas replacement device illustrated in FIG. 4 and the case where the undercover gassing was performed by the parallel comb-shaped nozzle of the prior art and the nozzle body having a buffer provided in the comb-shaped nozzle as Comparative Example, the residual air amount and the liquid spilled amount were evaluated by changing the replacement gas jet flow amount. Furthermore, the jet time is 0.04 seconds until the lid in the can lid seaming machine is positioned above the can body and the lid is closed.

Example 1

(1) Gas Replacement Device

Shape of blowout port: parallel comb-shaped nozzle

Blowing angle (replacement gas blowing angle): 120°

Height of blowout port (gas passageway): h=13 mm (2) Gas Replacement Condition

Can shape: can body of 350 ml (body diameter of 66 mm, opening diameter of 62 mm, and can neck portion height of 19.5 mm)

Can lid shape: lid height of 8 mm

Type and amount of contained liquid: saturated saline of 350 g

Head space volume: 30.2 ml

Replacement gas: carbon gas

Seaming speed: 1000 cpm

Replacement gas flow amount: 600, 800, 1000 Nl/min The examination was performed for the respective cases.

(3) Measurement Method

Residual air amount: as the initial setting of the head space, the gas of the head space was collected after the replacement of air, and the residual oxygen amount was measured by the oxygen concentration measurement device.

Liquid spilled amount: the liquid spilled amount was obtained by measuring a change in the weight before and after the passage to the seamer.

Figure 5:
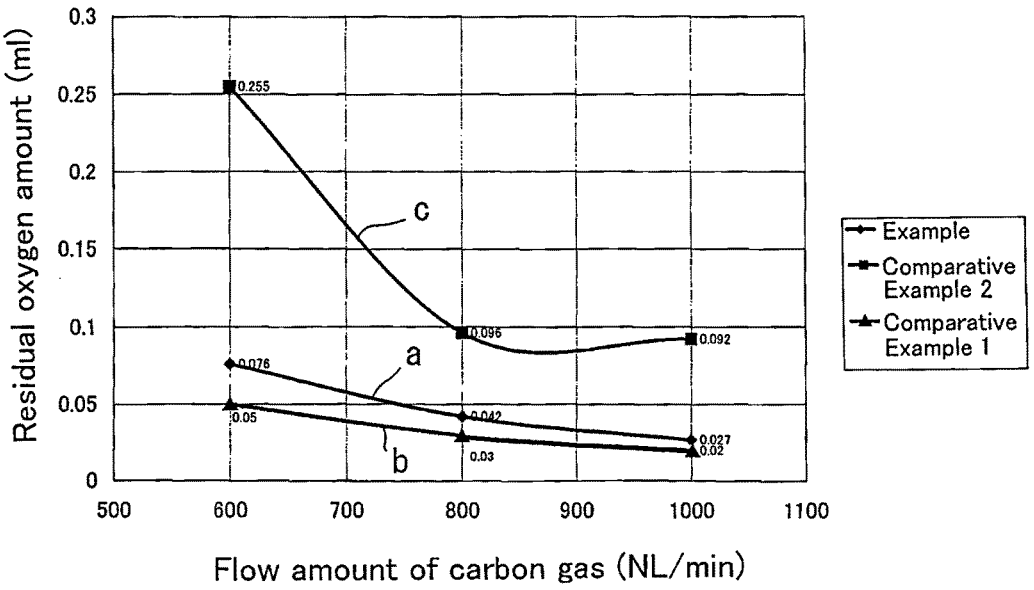
FIG. 5 is a graph illustrating a relation of a residual oxygen amount with respect to a flow amount of a replacement gas (a carbon gas) of Example and Comparative Examples 1 and 2.
Figure 6:
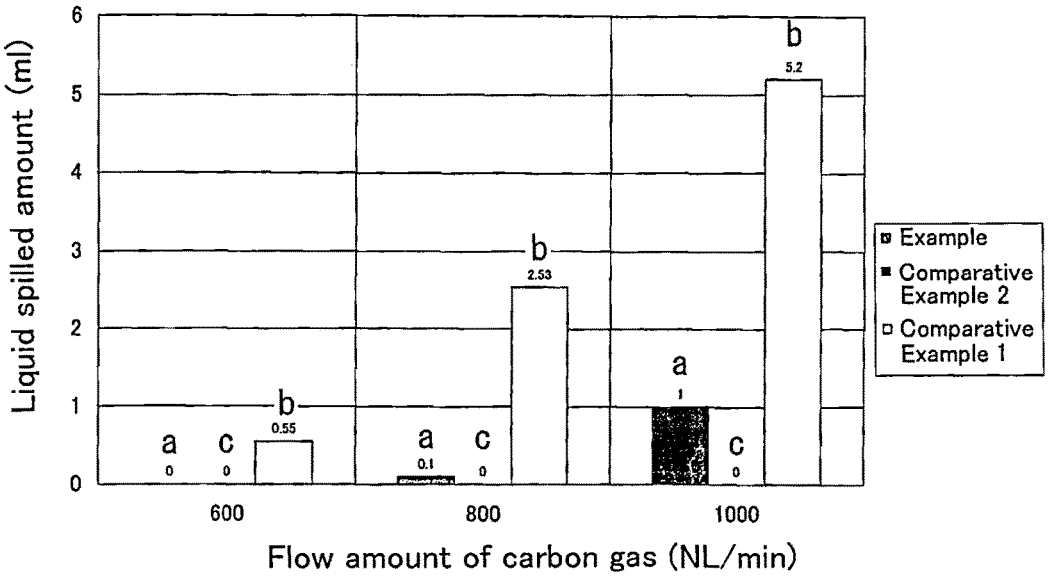
FIG. 6 is a graph illustrating a relation of a liquid spilled amount with respect to a flow amount of a replacement gas (a carbon gas) of Example and Comparative Examples 1 and 2.

The result is illustrated in the line a of FIG. 5 and the bar graph a of FIG. 6. FIG. 5 illustrates the residual oxygen amount of the head space when changing the replacement gas flow amount to 600, 800, and 1000 Nl/min, and FIG. 6 illustrates a change in the liquid spilled amount.

Comparative Example 1

As Comparative Example 1, a gas replacement device having a structure illustrated in FIG. 11 in which a nozzle height of a nozzle body was 8 mm was adopted. The other gas replacement conditions were the same as those of Example.

Comparative Example 2

As Comparative Example 2, a gas replacement device in which a replacement gas passageway was provided with a buffer and a nozzle was provided with radially arranged jet ports was adopted as in Patent Document 1. The other gas replacement conditions were the same as those of Example.

In Comparative Examples 1 and 2 above, the residual oxygen amount and the liquid spilled amount of the head space were measured when changing the replacement gas flow amount to 600, 800, and 1000 Nl/min. The above-described examination was performed on six cans even in each of Example and Comparative Examples. The average values of the measurement results of the respective residual oxygen amounts for the respective jet flow amounts are illustrated in FIG. 5 along with Example. In FIG. 5, the line (a) indicates Example, the line (b) indicates Comparative Example 1, and the line (c) indicates Comparative Example 2. Further, FIG. 6 illustrates the liquid spilled amount. Furthermore, in FIG. 6, a bar graph is displayed, and means that the liquid was not spilled at 800 Nl/min in Comparative Example 2.

From the graphs illustrating the above-described results illustrated in FIGS. 5 and 6, the following are proved.

(1) Regarding the residual oxygen amount, that is, the gas replacement rate, in the case of Example, when the flow amount increases from 600 Nl/min to 800 and 1000, the residual oxygen amount of the head space was halved from about 0.076 ml to 0.027 ml. In the case of Comparative Example 2, the residual oxygen amount was about 0.255 ml when the flow amount was 600 Nl/min, and the replacement rate was noticeably poor. When the flow amount increased to 800 and 1000 Nl/min, the residual oxygen amount decreased, and the replacement rate was improved. However, the residual oxygen amount was not really lowered from about 0.096 at 800 Nl/min or more, the residual oxygen amount was three times or more than that of Example, and the replacement rate was low.

(2) On the other hand, regarding the liquid spilled amount, in the case of Example 1, there was substantially no liquid spilled amount when the replacement gas flow amount was 800 Nl/min. Further, the liquid spilled amount was small such as 1 ml at 1000 Nl/min.

In Comparative Example 1, the residual oxygen amount was about 60% compared to Example, but the liquid spilled amount was five times or more than that of Example at 1000 Nl/min.

(3) From (1) and (2) above, in the prior art shown in Comparative Example 2, the replacement gas flow amount is extremely poor at 600 Nl/min, and at least 800 Nl/min is needed so as to obtain the practical gas replacement rate. On the contrary, at 600 Nl/min in Example 1, the residual oxygen amount may be largely decreased compared to 800 Nl/min of Comparative Example 2, and the practical replacement of the gas is sufficient at this amount. That is, according to Example, the use amount of the replacement gas may be saved by 30% or more compared to the gas replacement device of the prior art. Further, it is understood that the liquid spilled amount is almost zero when the replacement gas flow amount is 600 Nl/min. On the other hand, in Comparative Example 1, regarding the gas replacement rate, the result equaling or surpassing that of Example may be obtained. However, the liquid spilled amount is particularly larger than that of Example 1, and hence the spilling of the liquid may not be decreased.

Example 2

(1) Gas Replacement Device
Shape of blowout port: radial comb-shaped nozzle
Blowing angle (replacement gas blowing angle): 120°
Height of blowout port (gas passageway): h=12 mm
(2) Gas Replacement Condition
All conditions are the same as those of Example 1.
The result is illustrated in Table 1.

TABLE 1

| | Shape of Blowout Port | | Liquid Spilled Amount (cc) | | Residual Oxygen Amount (cc) | |
|---|---|---|---|---|---|---|
| | | | Flow | Flow | Flow | Flow |
| | Angle | Height mm | Amount cc 600 | Amount cc 900 | Amount cc 600 | Amount cc 900 |
| Example 2 | 120° | 12 | 0.47 | 0.58 | 0.42 | 0.08 |
| Comparative Example 3 | 100° | 7 | — | 0.84 | — | 0.16 |

Comparative Example 3

In the radial comb-shaped nozzle as in the nozzle body of Example 2, the liquid spilled amount and the residual oxygen amount were obtained by the numerical analysis in a case where the undercover gassing was performed at the replacement gas jet flow amount of 900 cc as in the gas replacement condition of Example 2 by using the nozzle body in which the blowing angle was 100° and the height of the blowout port was 7 mm. The result is illustrated in Table 1 together with Example 2.

As apparent from Table 1, even in the case of the radial comb-shaped nozzle, in Example 2 in which the blowing angle was 100° and the height of the blowout port is large such as 12 mm, the liquid spilled amount and the residual oxygen amount also apparently decreased compared to Comparative Example 3, and hence the effect of the invention was proved.

From the above-described results, in this invention, it is proved that there is a dramatic effect in which the gas replacement rate equaling or surpassing that of the prior art may be ensured at the small replacement gas flow amount and the liquid spilled amount is zero. As a result, when the invention is adopted in a bottler or a can manufacturer which needs a large replacement gas amount in a can manufacture, the replacement gas consumption amount may be saved by 30% or more and the cost may be largely reduced.

INDUSTRIAL APPLICABILITY

The invention may be used as a gas replacement device which blows a replacement gas into a head space of a container filled with contents so as to be replaced by a residual gas, and may obtain a high replacement rate and largely reduce spilling of a liquid by particularly decreasing a replacement gas flow amount. Accordingly, there is a high industrial applicability as an undercover gassing device of a can. However, the invention is not limited to the replacement of the gas of the can container, and may be also applied to, for example, a gas replacement device used directly before sealing a lid of a bottle-shaped container or a gas replacement device used before heat-sealing a lid material of a cup-shaped container.

The invention claimed is:

1. A method of replacing a gas of a container comprising blowing a replacement gas laterally from a replacement nozzle toward a gap between a can lid and a can body opening directly before covering an opening of a can body filled with contents by the can lid so that a gas remaining inside a head space of the can body is replaced by the replacement gas, wherein the space between replacement gas passageway outermost walls of the replacement nozzle are divided by a plurality of wind direction adjustment plates so as to form a plurality of blowout ports, wherein fingers are provided on the body of the replacement nozzle, wherein a replacement gas jet flows symmetrically blowing about a center line in the container radial direction from the blowout ports, the replacement gas jet flows blowing along the replacement gas passageway outermost walls form an angle of 100° to 130° there between, and wherein the replacement gas flow blows from the replacement nozzle to a range having ⅓ or more of a height of a can neck portion at the lower side from a can opening end or a depth of 3 mm or more in the can body direction from the can opening end; and a height of a can lid height or more at the upper side or a height of 3 mm or more at the upper side from the opening end, and wherein the can neck portion is a neck-downed area of the can body.

2. The method of replacing the gas of the container according to claim 1, wherein the wind direction adjustment plates are arranged in parallel to each other, and the replacement gas flows jetted from the opposing replacement gas passageway collide with each other on a center line in the container radial direction.

3. A device for gas replacement of a container comprising a replacement nozzle from which a replacement gas is blown toward a gap between a can lid and a can body opening directly before covering an opening of a can body filled with contents by the can lid so that a gas remaining inside a head space of the can body is replaced by the replacement gas, wherein the space between replacement gas passageway outermost walls of the replacement nozzle are divided by a wind direction adjustment plate so as to form a plurality of blowout ports which are arranged on a circular-arc and jet the replacement gas toward a container opening so as to be symmetrical about a center line in the container radial direction, wherein fingers are provided on the body of the replacement nozzle, wherein the blowout ports have a height of an opening which is higher than a sum of a can lid height and ⅓ or more of a height of a can neck portion at the lower side from a can opening end, or a sum of a depth of 3 mm or more and the can lid height or more at the upper side of the can, or a sum of a depth of 3 mm or more in the can body direction from the can opening end and a height of 3 mm or more from the can opening end at the upper side, or a sum of a height of 3mm or more from the can opening end at the upper side and ⅓ or more of a height of a can neck portion at the lower side from the can opening end, wherein an opening angle between the replacement gas passageway outermost walls is 100° to 130° , and wherein the can neck portion is a neck-downed area of the can body.

4. The device for gas replacement of a container according to claim 3, wherein the wind direction adjustment plates are arranged in parallel to one another.

* * * * *